United States Patent [19]

Greisch

[11] Patent Number: 4,564,503

[45] Date of Patent: Jan. 14, 1986

[54] MOUNT FOR FRAGILE TEST ELEMENT

[75] Inventor: Danny L. Greisch, Hilton, N.Y.

[73] Assignee: Eastman Kodak Company, Rochester, N.Y.

[21] Appl. No.: 523,489

[22] Filed: Aug. 15, 1983

[51] Int. Cl.[4] ..... B01L 9/00

[52] U.S. Cl. ..... 422/104; 40/152; 40/158 B; 356/244; 422/58

[58] Field of Search ..... 24/691, 682; 40/152, 40/158 B; 206/0.81–0.84; 220/308, 309, 293, 301; 248/222.3; 356/244; 411/349; 422/63, 66, 67, 58, 102, 104; 446/105, 106, 108, 111, 113, 119, 114, 122, 124

[56] References Cited

U.S. PATENT DOCUMENTS

| | | | |
|---|---|---|---|
| 7,318 | 4/1850 | Brown | 285/396 |
| 2,184,007 | 12/1939 | Staehle | 88/26 |
| 2,211,586 | 8/1940 | Schwarz | 411/349 X |
| 2,477,470 | 7/1949 | Williams | 40/158 |
| 2,626,773 | 1/1953 | Backman | 248/222.3 X |
| 2,861,368 | 11/1958 | Rosenberg | 40/158 |
| 2,940,558 | 6/1960 | Schlueter | 248/222.3 X |
| 3,069,795 | 12/1962 | Lieberman | 40/152 |
| 3,443,783 | 5/1969 | Fisher | 411/349 X |
| 3,581,422 | 6/1971 | Kono | 40/152 |
| 4,203,686 | 5/1980 | Bowman | 220/301 X |
| 4,230,757 | 10/1980 | Toner | 422/56 X |
| 4,250,641 | 2/1981 | Thompson | 40/158 |
| 4,387,990 | 6/1983 | Yazawa et al. | 422/58 X |
| 4,425,997 | 1/1984 | Grant | 206/0.82 X |

FOREIGN PATENT DOCUMENTS

| | | | |
|---|---|---|---|
| 2338936 | 2/1975 | Fed. Rep. of Germany | 446/113 |

OTHER PUBLICATIONS

American Dade; The Stratus System Tests, 1982.

*Primary Examiner*—Barry S. Richman
*Assistant Examiner*—Michael S. Gzybowski
*Attorney, Agent, or Firm*—Milton S. Sales

[57] ABSTRACT

Means for securing a fragile test element in a mount. A rectangular test element is inserted along an axis normal to the plane of the element and normal to the plane of the mount into a recess in the mount, past overhangs in the walls of the recess. The test element is then rotated about that axis into a position in which corners of the test element extend into undercuts below the overhangs. Various means are disclosed for providing engagement of the mount with the corners of the test element to inhibit further rotation of the test element.

2 Claims, 5 Drawing Figures

10
12
14
16
18
20
21
22
24
26
28
30
31
32
33
42
46
A

MOUNT FOR FRAGILE TEST ELEMENT

BACKGROUND OF THE INVENTION

1. Field of the Invention

The present invention relates generally to securing objects in mounts for support and ease of handling. The present invention relates more specifically to securing objects having a predetermined thickness in such mounts without using adhesives or sonic bonding. Objects mounted in accordance with the present invention are particularly useful in devices that determine the concentration of components of body fluids.

2. Description of the Prior Art

In recent years a number of automated systems have been developed to carry out quantitative chemical analysis of biological fluid samples. At least one known fluid analyzing apparatus uses discrete test elements upon which chemical analysis tests are conducted. The test elements contain dry reagents in a binder material. The test elements are transported through various process stations in the apparatus where they receive a drop of the biological fluid, are heat treated, and are evaluated, all automatically. Apparatus of this type is described in U.S. Pat. No. 4,152,390. The test elements may be of the type disclosed in U.S. Pat. No. 3,992,158.

A plastic mount is commonly provided to support and carry one such test element. The mounts are preferably formed of sheets of thermoplastic material which are bonded together to form an integral mount having a test element secured therein without the use of adhesives that might contaminate the test element. Examples of such mounts and methods using sonic bonding for forming the mounts and securing the test elements are described in U.S. Pat. Nos. 4,169,751 and 4,230,757. Each of the procedures disclosed therein places the test element to be mounted inside an aperture in one of two or more stacked sheets. The stacked sheets and the test element are then sonically bonded by compressive force and high-frequency vibratory energy. However, some test elements contain reagents having a binder material which is fragile to vibration, and the vibratory energy to which the test element is subjected during sonic bonding causes the surface of these at least partially fragile test elements to break up into a fine powder.

SUMMARY OF THE INVENTION

In accordance with the present invention, a method and article of manufacture are provided in which a non-circular object having a predetermined thickness, such as the test element described above, is secured in a mount. The object is inserted into a recess in the mount and rotated within the recess to a position in which part of the object extends into an undercut in the walls of the recess. The part of the object in the undercut is then engaged with the mount to inhibit further rotation of the object.

A mount in accordance with the present invention comprises a recess having at least one undercut in the walls of the recess, and means for engaging a part of the object in the undercut with the mount to inhibit further rotation of the object. The recess is adapted to permit insertion of the object into the recess along a predetermined axis. The undercut in the walls permits rotation of the object in the recess about the axis to a position whereat part of the object extends into the undercut. In a preferred embodiment, the mount has a camming wall defining the undercut. The camming wall is adapted to guide part of the object into the undercut.

The invention, and its objects and advantages, will become more apparent when the detailed description of the preferred embodiment presented below is considered in conjunction with the accompanying drawing.

BRIEF DESCRIPTION OF THE DRAWING

In the detailed description of the preferred embodiment of the invention presented below, reference is made to the accompanying drawing in which.

DESCRIPTION OF THE PREFERRED EMBODIMENT

Figures 1, 2, 3, 4, 5:
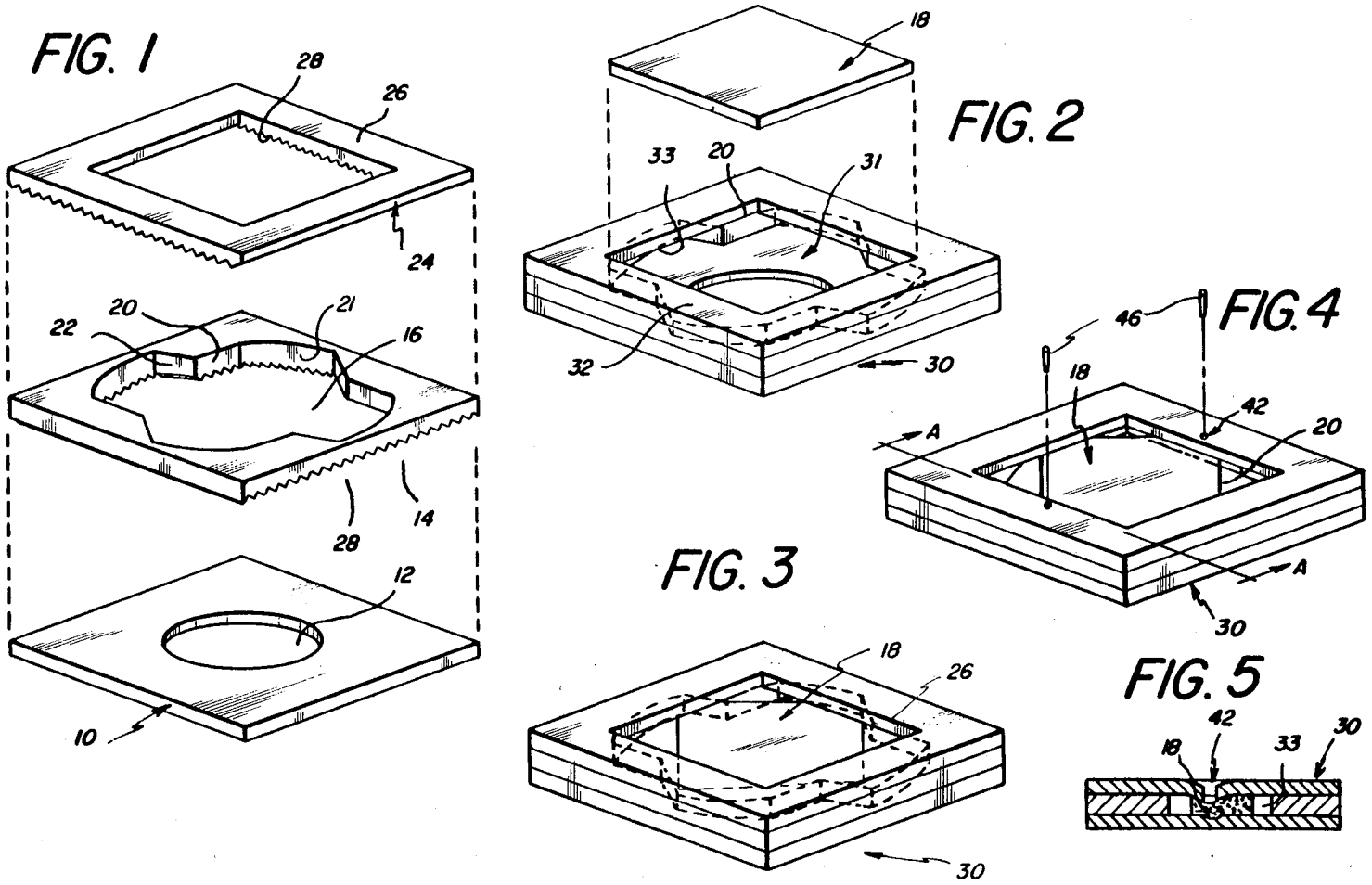
FIG. 1 is an exploded perspective view of a laminated mount in accordance with a preferred embodiment of the present invention.
FIG. 2 is an exploded perspective view of a test element and a mount in accordance with the present invention.
FIG. 3 is a diagrammatic perspective view of a test element in a mount in accordance with the present invention showing the rotation of the test element.
FIG. 4 is a diagrammatic perspective view of a test element in a mount in accordance with the present invention showing the engagement of the test element with the mount by embossing.
FIG. 5 is a cross-section view of the mount and test element shown in FIG. 4 taken at line A-A.

With reference to FIG. 1, bottommost sheet 10 is a sheet of thermoplastic web material such as polystyrene, polypropylene or polyamide. An aperture 12 extends through sheet 10 to permit a drop of fluid to pass therethrough. Both upper and lower surfaces of bottom sheet 10 are preferably flat.

Above sheet 10 in FIG. 1, an intermediate sheet 14 of similar material is provided with an aperture 16 for receiving a rectangular analytical test element 18 of the type hereinbefore described. Aperture 16 is defined by edges that provide connecting walls 20, camming walls 21, and stop walls 22. A top sheet 24 is provided above sheet 14. Top sheet 24 has a rectangular aperture 26 which is congruent with the perimeter of test element 18.

A plurality of energy director ribs 28 are formed on the underside of sheets 14 and 24 when the sheets are extruded. Sheets 14 and 24 are assembled together with sheet 10 so that the ribs 28 on sheet 14 are not parallel to the ribs 28 on sheet 24. Sheets 10, 14, and 24 are then subjected to sonic bonding as described in commonly assigned U.S. Pat. No. 4,169,751. After bonding, sheets 10, 14, and 24 form an integral mount 30 and apertures 26 and 16 in sheets 24 and 14 form a recess 31 in the mount. Sheet 24 provides overhangs 32 above undercuts 33 defined by camming walls 21 and stop walls 22 of aperture 16 in sheet 14.

Next, with reference to FIG. 2, test element 18 is inserted into recess 31 past overhangs 32 along an axis normal to the plane of test element 18 and normal to the plane of mount 30. Test element 18 is then rotated about this axis. When the test element rotates, curved camming walls 21 guide the four corners of test element 18 into a position against stop walls 22 in undercuts 33, as shown in FIG. 3. The depth of undercuts 33 (i.e., the distance between sheets 24 and 10) is parallel to and substantially equal to the thickness of the corners of test element 18 extending into undercuts 33. In this position the corners of test element 18 are frictionally engaged with overhangs 32, which inhibits rotation, and element 18 is retained in mount 30 by overhangs 32.

Finally, with reference to FIG. 4, overhangs 32 are pierced by two pins 46. The pins produce pin holes 42 in the mount and emboss overhangs 32 in mount 30 against the upper surface of test element 18. Pins 46 also emboss the undersurface of test element 18 against mount 30, as shown in FIG. 5. This embossing further inhibits rotation of test element 18. Thus, in the preferred embodiment, test element 18 is secured in mount 30 by frictionally engaging the corners of test element 18 extending into undercuts 33 in recess 31 and by embossing test element 18 together with mount 30.

Either frictionally engaging or embossing alone, or other means of engaging the mount with a test element may also be used. For example, pins made of stainless steel wire may be driven into the corners of the test element through the bottom of the mount and then cut off flush with the bottom surface of the mount. Alternatively, plastic stakes may be wedged into the mount against the test element through the pin holes that are produced when the test element and mount are embossed together. As a further alternative, the test element may be formed of a material such that moisture applied to the test element after the test element is rotated into the position shown in FIG. 3 will cause a permanent increase in the thickness of the test element that engages the mount with the test element by wedging the corners of the test element in the undercuts. Furthermore the test element, while having a predetermined thickness such that it can extend into an undercut in the walls of the recess in the mount, need not be of a uniform thickness. For example, the test element may have a boss at each corner which snaps into a complementary dimple in the mount, yet another means of engaging the mount with the test element.

By the present invention, I have provided a convenient means for securing a test element in a mount without the use of adhesives and without subjecting fragile test elements to the vibratory energy used in sonic bonding. Although described with respect to mounts for biological fluid test elements, it will be understood that the present invention is suitable for use in mounting sheet materials and other objects having a predetermined thickness. For instance, the invention described herein may be well-suited for mounting photographic transparencies.

Although the invention has been described with particular reference to a preferred embodiment thereof, it will be readily understood that variations and modifications can be effected within the spirit and scope of the invention as described hereinabove and as defined in the appended claims. For example, in the above-described preferred embodiment the mount is comprised of three sheets. However, the present invention provides similar benefits whether the mount is formed by laminating two or more layers or by molding the mount as a unit. For instance, mounts in accordance with the present invention may be formed by laminating a sheet having a molded recess with a sheet having an aperture adapted to permit insertion of a test element. Furthermore, in the preferred embodiment, the axis along which the test element is inserted is normal to the plane of the test element and to the plane of the mount, and the object secured in the mount is a test element. However the test element may, alternatively, be inserted along an axis that is oblique to the plane of rotation of the test element and to the plane of the mount, and objects other than test elements may be secured in mounts in accordance with the present invention.

I claim:

1. An article of manufacture comprising:

a non-circular, substantially planar, at least partially fragile object;

a mount having said object retained therein;

walls defining a recess in said mount adapted to permit insertion of said object into said recess along a predetermined axis;

at least one overhang above an undercut in said walls, said undercut constructed so that rotation of said object about said axis positions a part of said object within said undercut;

means for engaging said part of said object in its rotated position with said mount so that further rotation of said object is inhibited, wherein said means for engaging said object with said mount is at least one point at which said part of said object and said mount are embossed together, whereby said object is secured in said mount.

2. An article of manufacture comprising:

a non-circular, substantially planar, at least partially fragile object;

a mount having said object retained therein;

walls defining a recess in said mount adapted to permit insertion of said object into said recess;

at least one overhang above an undercut in said walls, said undercut constructed so that rotation of said object about said axis positions a part of said object within said undercut;

a camming wall in said undercut adapted to guide the object into said position; and means for engaging said part of said object in its rotated position with said mount so that further rotation of said object is inhibited, wherein said means for engaging said object with said mount is at least one point at which said part of said object and said mount are embossed together, whereby said object is secured in said mount.

* * * * *